US009885133B2

(12) United States Patent
Joung et al.

(10) Patent No.: US 9,885,133 B2
(45) Date of Patent: Feb. 6, 2018

(54) PENETRATION SYSTEM FOR FABRIC AND METHOD FOR MANUFACTURING FABRIC USING SAME

(71) Applicant: JIOS AEROGEL CORPORATION, Osan (KR)

(72) Inventors: Young Chul Joung, Hwaseong (KR); Myung Je Roh, Seoul (KR); Jong Chul Park, Osan (KR); Min Woo Kim, Daejeon (KR); Mun Hyeong Lee, Osan (KR); In Chang Cha, Osan (KR); Hyoung Gook Kim, Uijeongbu (KR)

(73) Assignee: JIOS Aerogel Limited, Wanchai (HK)

( * ) Notice: Subject to any disclaimer, the term of this patent is extended or adjusted under 35 U.S.C. 154(b) by 0 days.

(21) Appl. No.: 14/896,936

(22) PCT Filed: Jul. 22, 2013

(86) PCT No.: PCT/KR2013/006533
§ 371 (c)(1),
(2) Date: Dec. 9, 2015

(87) PCT Pub. No.: WO2014/200144
PCT Pub. Date: Dec. 18, 2014

(65) Prior Publication Data

US 2016/0222565 A1 Aug. 4, 2016

(30) Foreign Application Priority Data

Jun. 10, 2013 (KR) ..... 10-2013-0065708

(51) Int. Cl.
*D06B 1/12* (2006.01)
*D06B 3/18* (2006.01)
(Continued)

(52) U.S. Cl.
CPC ..... *D06B 1/12* (2013.01); *B05C 1/04* (2013.01); *B05D 1/26* (2013.01); *B05D 1/28* (2013.01);
(Continued)

(58) Field of Classification Search
CPC . D06B 1/10; D06B 3/10; D06B 3/201; D06B 5/08; D06B 5/22; D06B 23/24;
(Continued)

(56) References Cited

U.S. PATENT DOCUMENTS 5,948,314 A 9/1999 Gerhard et al.
2005/0100728 A1 5/2005 Ristic-Lehmann et al.
(Continued)

FOREIGN PATENT DOCUMENTS

EP 1065004 A1 1/2001
EP 1787716 A1 5/2007
(Continued)

OTHER PUBLICATIONS

Machine translation of JP H11-128824 A (Honen) generated Nov. 21, 2016, 9 pgs.*
(Continued)

*Primary Examiner* — William P Fletcher, III
(74) *Attorney, Agent, or Firm* — Morgan, Lewis & Bockius LLP

(57) ABSTRACT

A permeation system for permeating a wetting agent into fabric includes a fabric supply part; a permeation part provided with a permeation device and a height adjustment device; a drying part; and a collecting part for winding the fabric, which has passed through the drying part, around a collecting roll, thereby obtaining functional fabric of uniform quality and increasing productivity of the fabric into which the wetting agent is permeated. A method for manufacturing fabric includes adjusting the height of the perme-
(Continued)

ation paddle contacting the fabric; supplying the fabric; supplying a wetting agent to be permeated into the fabric; rotating the permeation roller and the permeation paddle to permeate the wetting agent into the fabric; drying the fabric into which the wetting agent is permeated; and collecting the fabric.

9 Claims, 3 Drawing Sheets

(51) Int. Cl.

| | |
|---|---|
| ***B05D 1/28*** | (2006.01) |
| ***B05D 1/26*** | (2006.01) |
| ***B05D 3/02*** | (2006.01) |
| ***B05D 5/00*** | (2006.01) |
| ***B05C 1/04*** | (2006.01) |
| ***D06B 3/10*** | (2006.01) |
| ***D06B 23/24*** | (2006.01) |
| ***D06B 5/22*** | (2006.01) |
| ***D06B 1/10*** | (2006.01) |
| ***D06B 3/20*** | (2006.01) |
| ***D06M 15/05*** | (2006.01) |
| ***D06M 15/333*** | (2006.01) |
| ***D06B 5/08*** | (2006.01) |

(52) U.S. Cl.
CPC ..... *B05D 3/0254* (2013.01); *B05D 5/00* (2013.01); *D06B 1/10* (2013.01); *D06B 3/10* (2013.01); *D06B 3/201* (2013.01); *D06B 5/08* (2013.01); *D06B 5/22* (2013.01); *D06B 23/24* (2013.01); *D06M 15/05* (2013.01); *D06M 15/333* (2013.01); *B05D 2203/00* (2013.01); *B05D 2252/00* (2013.01)

(58) Field of Classification Search
CPC ..... D06M 15/05; D06M 15/333; B05D 1/26; B05D 1/28; B05D 3/0254; B05D 5/00; B05D 2203/00; B05D 2252/00; B05C 1/04
USPC ..... 427/356, 412; 118/123
See application file for complete search history.

(56) References Cited

U.S. PATENT DOCUMENTS

| | | | |
|---|---|---|---|
| 2009/0148654 A1 | 6/2009 | Brown et al. | |
| 2009/0183826 A1 | 7/2009 | Calvert | |

FOREIGN PATENT DOCUMENTS

| | | | | |
|---|---|---|---|---|
| GB | 2187419 | A | | 9/1987 |
| JP | 11-128824 | A | | 5/1999 |
| JP | H11-128824 | A | * | 5/1999 |
| KR | 1019870000453 | B1 | | 3/1987 |
| KR | 940005759 | B1 | | 6/1994 |
| KR | 10-2012-0133856 | A | * | 12/2012 |
| KR | 20120133856 | A | | 12/2012 |
| WO | WO96/03353 | A1 | | 8/1996 |
| WO | WO03/064025 | A1 | | 8/2003 |
| WO | WO03/097227 | A1 | | 11/2003 |
| WO | WO2006/002440 | A2 | | 1/2006 |
| WO | WO2006/100277 | A1 | | 9/2006 |
| WO | WO2012/044052 | A2 | | 4/2012 |

OTHER PUBLICATIONS

JIOS Aerogel Limited, Communication Pursuant to Rules 161(2) and 162, EP13886647.0, Feb. 12, 2016, 2 pgs.
JIOS Aerogel Limited, Extended European Search Report, EP13886647.0, dated Mar. 28, 2017, 5 pgs.
JIOS Aerogel Limited, Communication Pursuant to Rules 161(2) and 162, EP13889597.4, Mar. 17, 2016, 2 pgs.
Armacell JIOS Aerogels Limited, Extended European Search Report, EP13889597.4, dated Mar. 29, 2017, 8 pgs.
JIOS Aerogel Corporation, Communication Pursuant to Rules 161(2) and 162, EP13890228.3, Mar. 2, 2016, 2pgs.
Armacell JIOS Aerogesl Limited, Partial Supplementary European Search Report, EP13890228.3, dated Feb. 8, 2017, 8pgs.
JIOS Aerogel Corporation, Communication Pursuant to Rules 161(2) and 162, EP14898765.4, Mar. 9, 2017, 2pgs.

* cited by examiner

PENETRATION SYSTEM FOR FABRIC AND METHOD FOR MANUFACTURING FABRIC USING SAME

TECHNICAL FIELD

The present invention relates to a permeation device for permeating a wetting agent to fabric, for insulation, waterproofing, antifouling, antibacterial, flame retardant, and other properties, and specifically to a permeation system for permeating a supplied wetting agent to fabric with a rotary permeation paddle device and a method for manufacturing fabrics using the same.

BACKGROUND

Generally, clothing has been means for protecting human bodies from external environments and, in modern days, has become means of fashion for expressing oneself to others. Recently, functional clothing having insulation, waterproofing, antifouling, antibacterial, flame retardant, and other advantageous properties, in addition to being means of fashion, is drawing attention. To manufacture such clothing, special processing is performed on fabrics.

As an example, fabric having insulation functionality is permeated with aerogel, which is used as an insulation material due to its very low thermal conductivity. The aerogel has been recognized as a novel material, made of silicon oxide (SiO2), which has drawn attention, since its discovery in the 1930s, as an insulation material, an impact absorbing material, and a soundproofing material, etc. as it is resistant to heat, electricity, sound, and impact, etc., and is only three times as heavy as air of the same volume. Further, aerogel is formed of silicon oxide threads having a diameter of one ten-thousandth of human hair, tangled extremely sparsely, and air molecules occupy the space between threads, and air accounts for 98% of the total volume.

A system and method of processing fabric using aerogel as a wetting agent is disclosed in Korean Patent No. 01255631, which was granted from a patent application filed by the present applicant. In short, the patented system includes a mixture supply part, a non-woven fabric supply roll, an insulation processing and transporting part permeating a mixture into a non-woven fabric using a blade, a drying part, and an insulation padding collecting roll.

SUMMARY OF THE INVENTION

However, when using a blade, a mixture is permeated slowly, the permeation takes a long time, and thus a lengthy permeation process is required. Accordingly, the processing time of the overall process is long, which is disadvantageous.

The present invention resolves the above problems, and aims to provide (i) a fabric permeation system by permeating into fabric a wetting agent which provides functionality, using a rotary permeation paddle device, thereby significantly shortening the time spent on permeation process and continuously and quickly performing the permeation process, which shortens the processing time of the overall process, and (ii) a method of manufacturing fabric using the same.

As described above, according to the present invention, a rotary permeation paddle device permeates into fabric the wetting agent transported to the rotary permeation paddle device by evenly spreading the supplied wetting agent with a permeation paddle and uniformly applying it to the fabric, thereby obtaining homogeneous functional fabric.

Also, the described embodiments provide a simplified permeation process with a reduced processing time, which has an effect of increasing the productivity of manufacturing fabric permeated with the wetting agent.

BRIEF DESCRIPTION OF DRAWINGS

The accompanying drawings attached to the specification illustrate embodiments of the present invention, which, when viewed in conjunction with the detailed description of the invention, assist better understanding of the technical aspects of the present invention. However, the drawings should not be construed to limit the scope of the present invention.

EXPLANATION ON REFERENCE NUMERALS

Figure 1:
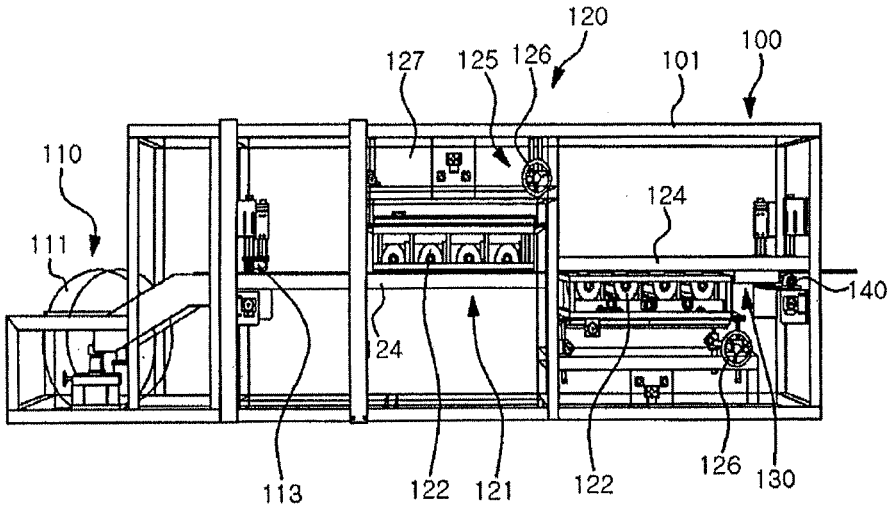
FIG. 1 is a front view schematically illustrating a fabric permeation system according to an embodiment of the present invention.

100: Body
101: Frame
110: Fabric supply part
111: Supply roll
112: Tension plate
113: Supply roller
120: Permeation part
121: Permeation device
122: Permeation roller
123: Permeation paddle
124: Support member
125: Height adjustment device
126: Handle
127: Wetting agent supply device
128: Supply hopper
129: Supply tube
130: Drying part

DETAILED DESCRIPTION

In order to achieve the objects described above, a fabric permeation system according to the present invention, the system for permeating a wetting agent into fabric, is characterized by including a fabric supply part including a supply roll around which the fabric is wound; a permeation part 120 including a wetting agent supply device configured to accommodate and supply a wetting agent to the fabric supplied from the supply roll, at a supply hopper, a permeation device with multiple permeation paddles installed in a permeation roller at predetermined intervals for permeating the wetting agent supplied from the supply hopper into the fabric, and a height adjustment device adjusting a permeation pressure by adjusting a distance between the permeation paddle and the fabric; a drying part drying the fabric into which the wetting agent is permeated by the permeation paddle; and a collecting part winding the fabric, which passes through the drying part, around a collecting roll.

In some embodiments, the permeation roller and the permeation paddle are characterized by being installed to rotate in a reverse direction with respect to a movement direction of the fabric.

In some embodiments, the permeation system is characterized by further including a supply tube formed in a lower part of the supply hopper, wherein the supply tube is bent towards the permeation paddle, being located farther backward than the permeation paddle with respect to the movement direction of the fabric, such that the wetting agent is smeared on the permeation paddle and applied to the fabric.

In some embodiments, an end of the supply tube is characterized by forming an inclined angle, such that the wetting agent is evenly smeared while the permeation paddle is rotating.

In some embodiments, the permeation system is characterized by further including a supply tube formed in a lower part of the supply hopper, wherein the supply tube is located farther forward than the permeation paddle with respect to the movement direction, such that when the supply tube drops the wetting agent to the fabric, the permeation paddle permeates the wetting agent, being rotated.

Meanwhile, a method of manufacturing fabric using the fabric permeation system according to the present invention is characterized by including step 1 of adjusting the height of a permeation paddle contacting the fabric (S10); step 2 of supplying the fabric (S20); step 3 of supplying a wetting agent to be permeated into the fabric (S30); step 4 of rotating the permeation roller and the permeation paddle to permeate the wetting agent into the fabric (S40); step 5 of drying the fabric into which the wetting agent is permeated (S50); and step 6 of collecting the fabric (S60).

In some embodiments, it is characterized in that in step 1 (S10), a contact area and a contact pressure between the permeation paddle and the fabric are adjusted by adjusting the height of the permeation paddle.

In some embodiments, it is characterized in that in step 3 (S30), the wetting agent is supplied to the permeation paddle through a supply tube of a supply hopper, such that the wetting agent is smeared on the paddle and then applied to the fabric.

Hereinafter, with reference to the accompanying drawings, the present invention is described in detail with preferred embodiments so that a person having ordinary knowledge in the art to which the present invention pertains can easily carry out the present invention. However, in describing in detail the operation principle of the preferred embodiments of the present invention, the detailed descriptions on the disclosed functions or constitutions, are determined to make the gist of the present invention unclear unnecessarily, they are omitted.

Construction of the Permeation System

Figure 2:
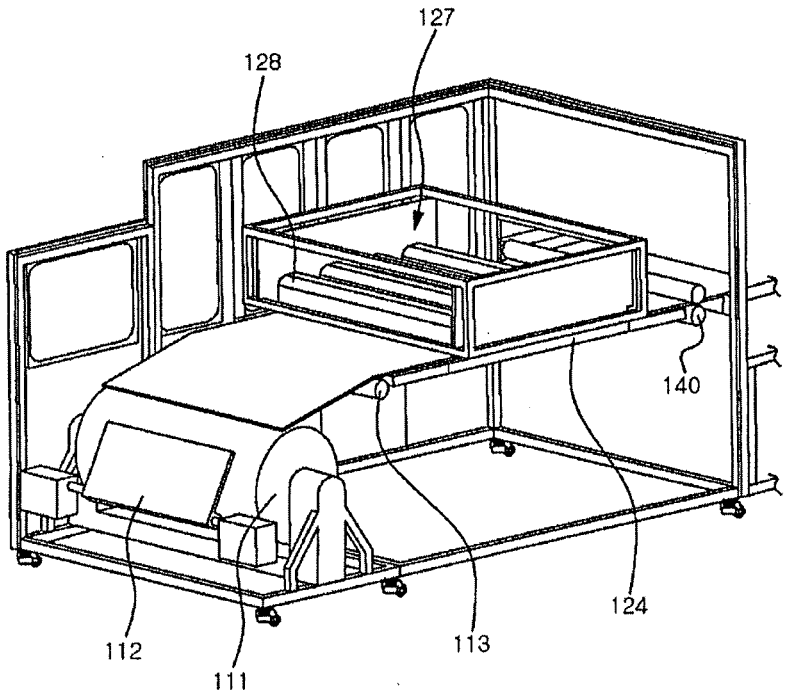
FIG. 2 is a perspective view illustrating major components of the permeation system illustrated in FIG. 1.
Figure 3:
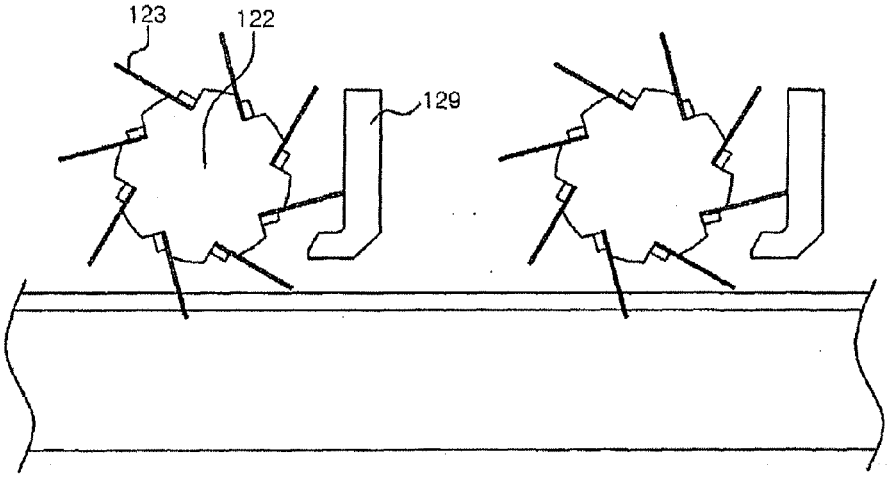
FIG. 3 is a front view illustrating part of a rotary permeation paddle device illustrated in FIG. 1.
Figure 4:
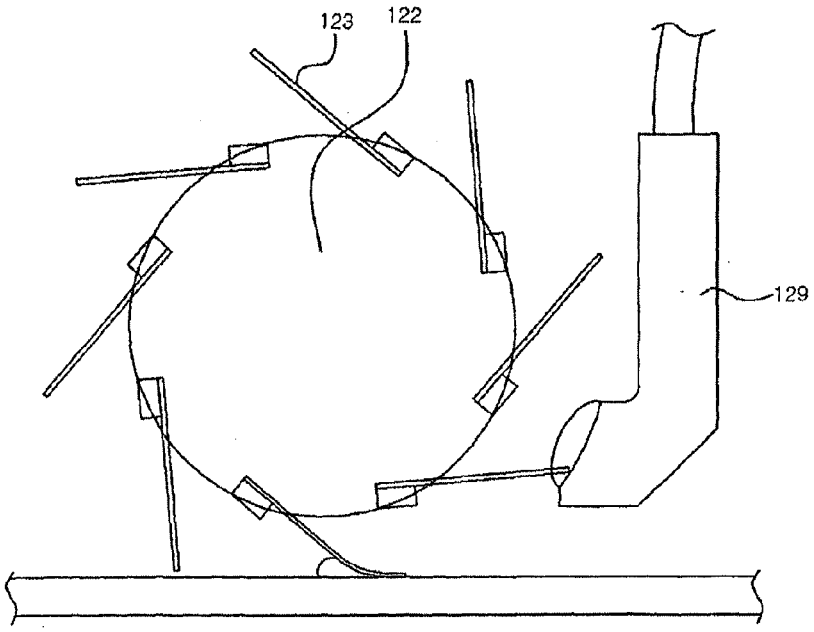
FIG. 4 is a front view schematically illustrating the operation of the rotary permeation paddle device of FIG. 3.

FIG. 1 is a front view schematically illustrating a fabric permeation system according to a preferred embodiment of the present invention, FIG. 2 is a perspective view illustrating the main constitution of the permeation system illustrated in FIG. 1, FIG. 3 is a front view illustrating the operation principle of a rotary permeation paddle device illustrated in FIG. 1, and FIG. 4 is a front view schematically illustrating the operation of the rotary permeation paddle device of FIG. 3. The permeation system of the present invention is for permeating a functional wetting agent to fabric, and may be used for producing all kinds of products including clothing, shoes, bags, and hats, etc., which can be manufactured with fabric into which the wetting agent is permeated. Hereinafter, for the sake of convenience, the description is limited to clothing.

The fabric permeation system according to the present invention is formed by including a body 100, a fabric supply part 110, a permeation part 120, a drying part 130, and a fabric collecting part, as shown in FIG. 1 to FIG. 4. Here, the fabric is for manufacturing padding with excellent insulation function by being permeated with an aerogel powder, and may be used for manufacturing clothing with insulation function, in addition to padding. Also, wetting agents with heating, moisture permeation, waterproofing, antifouling, antibacterial, and flame retardant, etc. properties, in addition to insulation property, may be used for manufacturing various kinds of clothing.

First, the body 100 is formed by fastening multiple frames 101 to each other, and fixes the fabric supply part 100, the permeation part 120, the drying part 130, and the fabric collecting part to positions where each of them can perform their functions. The body 100 may be configured to close an inter space and include the above constituents in the inter space.

The fabric supply part 110, which is for supplying fabric requiring permeation, includes a supply roll 111 installed in a side part of the body 100, around which fabric is wound, a tension plate 112 adjusting the fabric tight, which passes through the permeation part 120 from the supply roll 111 and is wound again around a collect roll, and a supply roller 113 installed such that the fabric which moves through the tension plate 112 is converted to an angle (for example, horizontal) optimal for permeation, while consistently maintaining a tight state.

Here, as shown in FIG. 2, the tension plate 112 is installed to contact the surface of the outermost fabric wound around the supply roll 111 at a constant tension, to supply the fabric unrolled and supplied from the supply roll 111 in a tight state.

Further, as shown in FIG. 1 and FIG. 2, the supply roller 113, which is a member allowing the fabric wound around the supply roll 111 to be smoothly converted to a horizontal state while unrolling and moving, is installed between the supply roll 111 and the permeation part 120.

The permeation part 120 is formed by including a permeation device 121, a height adjustment device 125, and a wetting agent supply device 127.

First, as shown in FIG. 3 and FIG. 4, the permeation device 121, which is a device for permeating the wetting agent supplied from the wetting agent supply device 127 to fabric, is formed by including a permeation roller 122, a permeation paddle 123, and a support member 124.

First, the permeation roller 122 is installed to rotate by a supply source (not shown) such as a motor, etc., in the body 100. Further, in one permeation roller 122, multiple permeation paddles 123 are mounted. One or multiple permeation roller 122 may be installed as needed, in an upper part or a lower part of the fabric, or in the upper part and the lower part alternately. Of course, the same number of the wetting agent supply device 127, which supplies the wetting agent to the permeation device 121, as that of the permeation device 121 is installed.

Also, multiple permeation paddles 123 are installed in one permeation roller 122 at predetermined intervals, and are manufactured using urethane or teflon having elasticity, so as for a contact region to be bent when contacting the fabric. Further, the permeation paddle 123 may be manufactured with a thin free end side and a thick basal end side, so as to increase contact force according to the contact region between the permeation paddle 123 and the fabric. In addition, the permeation paddle 123 is manufactured to have a width identical at least or greater than that of fabric, so as to permeate the wetting agent with respect to the full width of the fabric, and the permeation roller 122, onto which the permeation paddle 123 is mounted, is manufactured to have a width identical or greater than that of the permeation paddle 123.

Further, the support member 124 is a member installed at a side of the fabric for preventing the fabric from being loosened when the permeation paddle 123 permeates the wetting agent by pressing the fabric. The support member 124 may be a fixed plate or a conveyor belt moving with the fabric. At this time, the belt may have a flat plane so as to be in uniform contact with the fabric. Also, the same number of the support member 124 as that of the permeation roller 122 is installed. When the permeation roller 122 is installed in the upper part and the lower part of the fabric alternately, the support member 124 is installed to arrange the fabric in a gap with the permeation roller 122.

Thus, a large amount of the wetting agent can be quickly permeated into the fabric with a constant thickness, and by adjusting the contact area and the contact pressure between the permeation paddle 123 and the fabric according to cases by adjusting the height of the permeation paddle 123, by the support member 124 preventing the fabric from being loosened while multiple permeation paddles 123 contact the fabric and permeate the wetting agent in one rotation of the permeation roller 122. Therefore, the permeation process time can be significantly shortened and the permeation efficiency can be increased by controlling the moving speed of the fabric and the rotating speed of the permeation roller 122.

The height adjustment device 125, which is a device adjusting the height of the permeation device 121, is installed to adjust the contact area and contact force between the permeation paddle 123 and the fabric, to adjust the height of the wetting agent permeated into the fabric or the height of the fabric into which the wetting agent is permeated. The height adjustment device 125 includes a handle 126, as shown in FIG. 1, and is installed to adjust the height of the permeation device 121 by turning the handle 126. As another manner, a driving source such as a motor may be included to change the height of the permeation device 121 with operation of the driving source by pressing an ascending or descending button.

The wetting agent supply device 127 includes a hopper to store and supply a wetting agent for providing functionality to the fabric. The wetting agent supply device 127 is formed, for example, by including a storage hopper (not shown) storing each of multiple raw materials constituting a wetting agent, and a supply hopper 128 mixing the raw materials supplied from the storage hopper at a predetermined ratio and supplying the mixture. As another example of the wetting agent supply device 127, as shown in FIG. 2, the wetting agent supply device may be formed with the supply hopper 128 alone, which accommodates and supplies a wetting agent where the raw materials are premixed.

A supply tube 129, which is located in the lower part of the supply hopper 128, is located in back of the permeation paddle 123 of the permeation device 121 with respect to the transporting direction of the fabric and is bent towards the permeation paddle 123, as shown in FIG. 4, such that the rotating permeation paddle 123 is smeared with the wetting agent to coat it on the fabric.

Also, an end of the supply tube 129 is formed to have a predetermined inclined angle, such that the wetting agent is smeared well according to a rotation angle of the permeation paddle 123. The supply hopper 128, specifically the supply tube 129 of the supply hopper 128, has a width identical or similar to that of the permeation paddle 123, such that the permeation paddle 123 applies the wetting agent evenly with respect to the full width of the fabric. Of course, an amount of the wetting agent supplied from the supply tube 129 is provided uniformly with respect to the full width of the supply tube 129.

Also, the supply tube 129 may not be bent, so as to drop the wetting agent directly to the fabric. In this case, the wetting agent supply device 127 is located farther forward than the permeation device 121 with respect to the movement direction of the fabric and may permeate the wetting agent dropped from the supply tube 129 to the fabric, while the permeation roller 122 and the permeation paddle 123 rotate in a reverse direction with respect to the movement direction of the fabric.

Here, the wetting agent is for providing the fabric with insulation, heating, moisture permeation, waterproofing, antifouling, antibacterial, and flame retardant, etc. functions. Hereinafter, for the sake of convenience, the description is limited to a wetting agent for insulation including aerogel for insulation. Thus, the wetting agent includes an aerogel power and an adhesive binder, and further includes an additive, as needed.

Here, aerogel is a novel material, which is light, and draws attention as an insulation material, an impact absorbing material, and a soundproofing material, etc., as described in the background art above. In the present invention, an aerogel powder is used for permeating aerogel into fabric. Further, the adhesive binder includes at least one of cellulose-based, starch-based, epoxy-based, polyvinyl alcohol-based, and urethane-based materials. In addition, the additive includes at least one of a filler or a foaming agent. The filler refers to at least one of plaster, a silica powder, and a perlite particle, and the foaming agent refers to at least one of polyacrylate polymers, sodium hydrogen carbonate, an aluminum magnesium carbonate powder, a zinc powder, calcium carbonate, and a CAS blowing agent.

Meanwhile, the drying part 130 is installed in back of the permeation part 120, so as to emit hot or warm air for drying an organic solvent and residual moisture remaining in fabric, with respect to the moving fabric into which the wetting agent is permeated.

Also, the fabric collecting part includes a discharge roller 140 for moving the fabric of the supply roll 111 and a collecting roll (not shown) winding the dried fabric again. Here, the discharge roller 140 is located between the drying part 130 and the collecting roll with respect to the movement direction of the fabric, as shown in FIG. 1, and guides the original fabric of the supply roll 111 to pass through the permeation part 120 and the drying part 130 to move horizontally, and then have a predetermined angle to be wound smoothly around the collecting roll.

Also, the collecting roll provides an external force allowing movement of the fabric of the supply roll 111. Thus, the moving speed of the fabric is controlled by the collecting roll. Of course, the moving speed of the fabric by the collecting roll is associated with the rotating speed of the permeation roller 122 and the permeation paddle 123 of the permeation device 121.

Method

Figure 5:
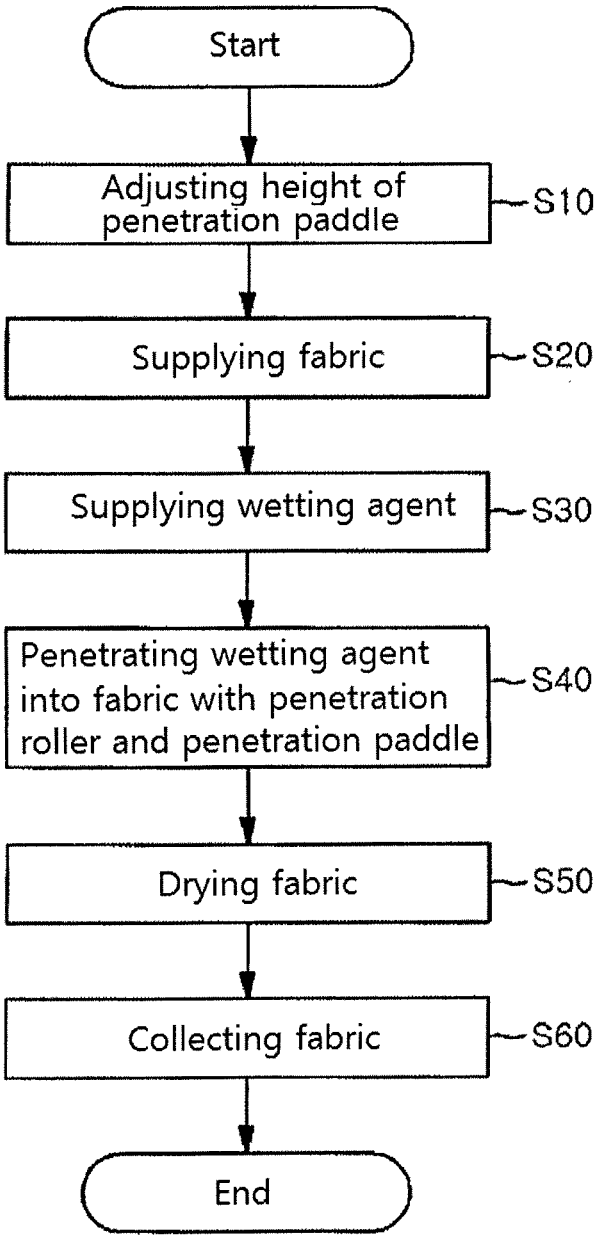
FIG. 5 is a flow chart illustrating a method of manufacturing fabric using the permeation system of FIG. 1.

FIG. 5 is a flow chart illustrating a method of manufacturing fabric using the permeation system of FIG. 1.

The method of manufacturing fabric using the permeation system according to the present invention first adjusts the height of the permeation paddle 123 contacting the fabric, with the height adjustment device 125, for adjusting the permeation thickness of a wetting agent (S10). At this time, when the permeation paddle 123 is located close to the fabric and the contact area between the permeation paddle 123 and the fabric is larger, a permeation pressure permeating the wetting agent is higher, and when the permeation paddle 123 is located far from the fabric and the contact area between the permeation paddle 123 and the fabric is smaller, a permeation pressure permeating the wetting agent is lower. Thus, a distance between the permeation paddle 123 and the fabric is properly adjusted according to elasticity of the permeation paddle 123 or the properties of the wetting agent, such as degree of watery property, etc.

Next, the fabric is supplied (S20). To this end, a side part of the fabric which is wound around the supply roll 111 passes through the supply roller 113 and the discharge roller 140, and is wound around the collecting roll. Thereafter, the fabric is pulled while the collecting roll is rotating, and the fabric unrolled from the supply roll 111 passes through the permeation part 120 and the drying part 130 and moves.

Next, the wetting agent is supplied (S30). Here, the wetting agent mixing a variety of raw materials provided at a predetermined ratio from the storage hopper storing each of the variety of raw materials, is discharged outside through the supply tube 129 of the supply hopper 128.

Next, the wetting agent is permeated into the fabric by rotating the permeation roller 122 and the permeation paddle 123 (S40). Here, the wetting agent discharged from the supply tube 129 may be permeated by being smeared on the permeation paddle 123 while the permeation paddle is rotating and applied to the fabric, or may be permeated by rotating the permeation paddle 123 in a state where the wetting agent is directly dropped to the fabric.

Of course, when the wetting agent is applied to the fabric using the permeation paddle 123, the supply tube 129 is located farther backward than the permeation paddle 123 with respect to the fabric transporting direction. When the wetting agent dropped to the fabric is permeated by the permeation paddle 123, the supply tube 129 is located farther forward than the permeation paddle 123 with respect to the fabric transporting direction.

Next, the fabric into which the wetting agent is permeated is dried (S50). Here, the fabric passes through the drying part 130 emitting hot or warm air, and at this time, an organic solvent and residual moisture remaining in the fabric are dried.

Finally, the fabric is collected (S60). The fabric dried by passing through the drying part 130 is wound again around the collecting roll.

As described above, a person skilled in the art to which the present invention pertains can understand that the present invention can be carried out in different embodiments without modifying the technical sprit or essential characteristics. Thus, it should be understood that the above-described embodiments are by way of example only in every aspect, and are not intended to limit the present invention. The scope of the present invention is defined by the following claims, rather than by the detailed description. Further, it should be appreciated that all modifications or modified forms derived from the definition, scope, and equivalents of the claims fall under the scope of the present invention.

What is claimed is:

1. A fabric permeation system, the system for permeating a wetting agent into the fabric, characterized by comprising:

a fabric supply part comprising a supply roll around which the fabric is wound;

a permeation part comprising a wetting agent supply device configured to accommodate and supply a wetting agent to the fabric supplied from the supply roll, at a supply hopper, a permeation device with multiple permeation paddles installed in a permeation roller at predetermined intervals for permeating the wetting agent supplied from the supply hopper into the fabric while the permeation paddles rotate, and a height adjustment device adjusting a permeation pressure by adjusting a distance between a permeation paddle and the fabric;

a drying part drying the fabric into which the wetting agent is permeated by the permeation paddles; and a fabric collecting part winding the fabric, which passes through the drying part, around a collecting roll.

2. The system of claim 1, characterized in that the permeation roller and the permeation paddles are installed to rotate in a reverse direction with respect to a movement direction of the fabric.

3. The system of claim 1, characterized by further comprising a supply tube formed in a lower part of the supply hopper, wherein the supply tube is bent towards the permeation paddles, being located in farther backward than the permeation paddles with respect to the movement direction of the fabric, such that the wetting agent is smeared on the permeation paddles and applied to the fabric.

4. The system of claim 3, characterized in that an end of the supply tube forms an inclined angle, such that the wetting agent is smeared while the permeation paddles are rotating.

5. The system of claim 1, characterized by further comprising a supply tube formed in a lower part of the supply hopper, wherein the supply tube is located farther forward than the permeation paddles with respect to the movement direction, such that when the supply tube drops the wetting agent to the fabric, the permeation paddles rotate and permeate the wetting agent.

6. The system of claim 1, characterized in that the permeation device is configured to apply a pressure sufficient to cause permeation of the wetting agent into the fabric.

7. A method of manufacturing fabric with the fabric permeation system of any one of claims 1 to 5, characterized by comprising:

step 1 of adjusting the height of the permeation paddles from the fabric (S10);

step 2 of supplying the fabric (S20);

step 3 of supplying a wetting agent to be permeated into the fabric (S30);

step 4 of rotating the permeation roller and the permeation paddles to permeate the wetting agent into the fabric (S40);

step 5 of drying the fabric into which the wetting agent is permeated (S50); and step 6 of collecting the fabric (S60).

8. The method of claim 7, characterized in that in step 1 (S10), a contact area and a contact pressure between the permeation paddle and the fabric are adjusted by adjusting the height of the permeation paddle.

9. The method of claim 7, characterized in that in step 3 (S30), the wetting agent is supplied to the permeation paddle through the supply tube of the supply hopper, such that the wetting agent is smeared on the permeation paddle and then applied to the fabric.

* * * * *